United States Patent [19]

Chase

[11] Patent Number: 4,883,443

[45] Date of Patent: Nov. 28, 1989

[54] FOLDING PLAY STRUCTURE

[76] Inventor: Herbert S. Chase, One Lincoln Plaza, New York, N.Y. 10398

[21] Appl. No.: 242,561

[22] Filed: Sep. 12, 1988

[51] Int. Cl.[4] ..... A63H 3/52; A63H 33/00

[52] U.S. Cl. ..... 446/478; 446/487

[58] Field of Search ..... 446/478, 476, 479, 487, 446/488, 75; 108/111, 112, 115

[56] References Cited

U.S. PATENT DOCUMENTS

| | | | |
|---|---|---|---|
| 243,873 | 7/1881 | Dorn | 446/478 |
| 1,428,405 | 9/1922 | Wegener | 446/478 |
| 2,259,783 | 10/1941 | Sparling | 446/478 |
| 2,872,753 | 2/1959 | Fenton | 446/478 |
| 3,231,942 | 2/1966 | O'Brien | 446/478 |
| 3,341,987 | 9/1967 | Johansson | 446/478 |
| 3,845,727 | 11/1974 | Chase | 108/115 |
| 4,070,789 | 1/1978 | Levenson | 446/478 |
| 4,508,519 | 4/1985 | Becker | 446/478 |

FOREIGN PATENT DOCUMENTS

| | | | |
|---|---|---|---|
| 700976 | 12/1964 | Canada | 446/478 |
| 69058 | 3/1927 | Sweden | 446/478 |

OTHER PUBLICATIONS

H. A Fluchere, Popular Mechanics, Nov. 1962, pp. 158–159.

*Primary Examiner*—Robert A. Hafer
*Assistant Examiner*—Michael Brown
*Attorney, Agent, or Firm*—Wolder, Gross & Yavner

[57] ABSTRACT

A collapsible play structure, such as a doll house, is formed with a base unit having storage means, such as drawers, located therein. A pair of opposed parallel and upright side wall panels, are pivotly mounted to the base, and a plurality or horizontal panels are pivotly mounted to and between the side walls to form the floors and ceilings of the unit. A front wall panel extends upwardly between the side walls and is pivotly attached to the front edge of one of the horizontal panels. Lock means are provided on the horizontal panels and on the front wall panel to removably join the horizontal and front wall panels together to permit the structure to be retained in the upright and upstanding position.

13 Claims, 4 Drawing Sheets

FIG. 6
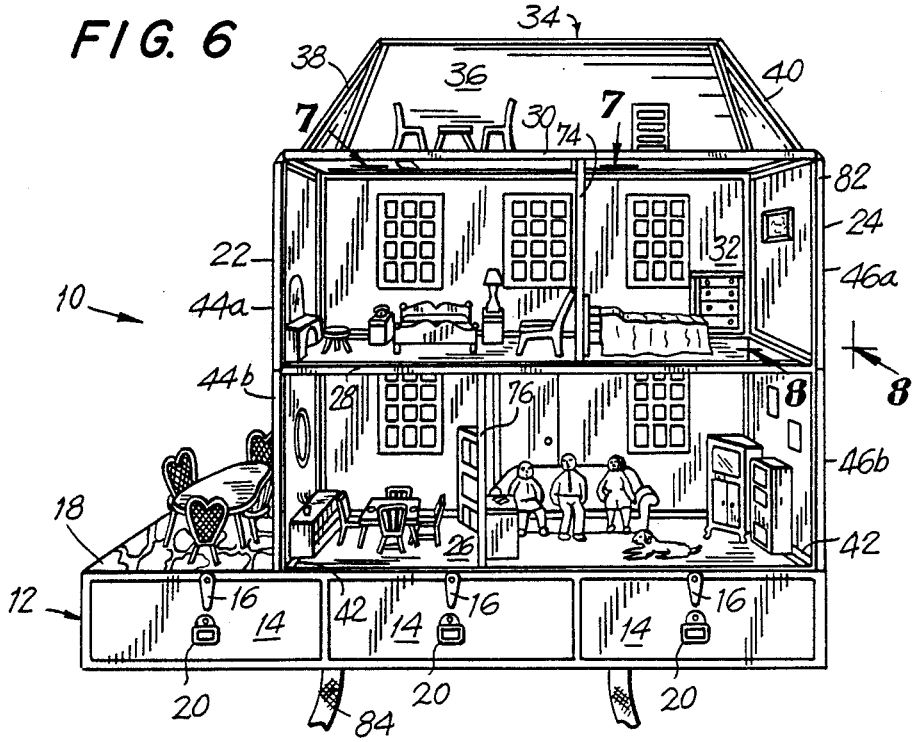
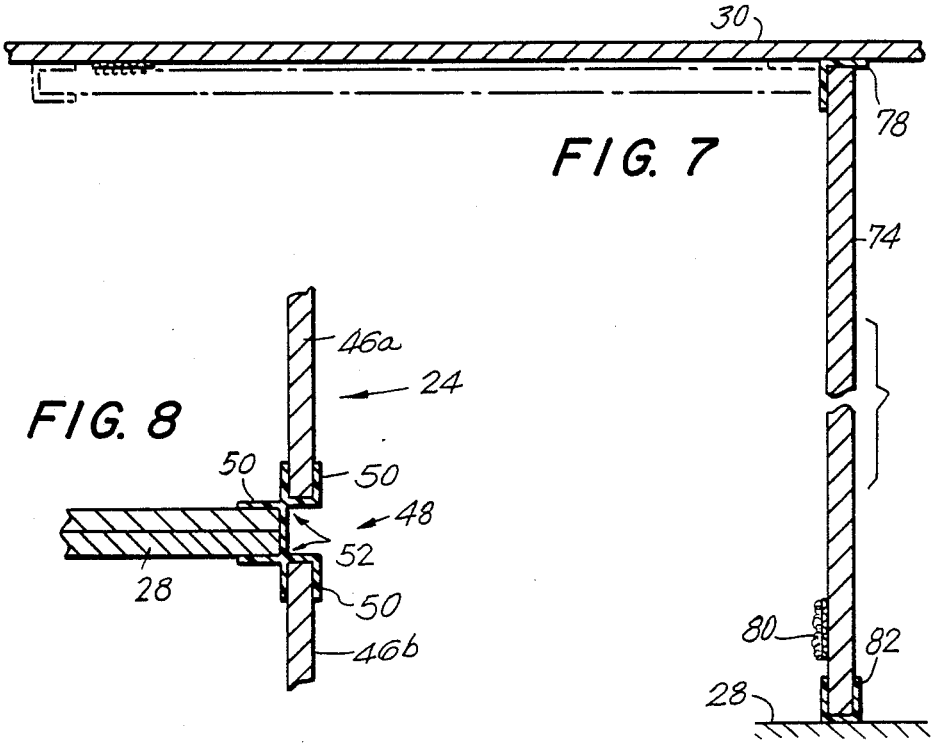
FIG. 7
FIG. 8

FOLDING PLAY STRUCTURE

BACKGROUND OF THE INVENTION

The present invention relates to a play structure and, in particular, to a play structure such as a dollhouse, which may be collapsed to a convenient, compact form for storage and/or transport.

Model play structures, such as dollhouses, castles, forts and the like have been a mainstay of children's playtime equipment. When used in conjunction with appropriately sized dolls and ancillary equipment, such structures provide hours of entertainment for a child, and permit the healthy expression of the child's understandings, as well as fantasies, of life and the varieties of situations which may be portrayed by the equipment.

The very feature of such structures, namely their ability to support and display dolls and other items which are employed with the structures, causes them to be of a size which creates an unwieldy and awkward unit for storage or transportation, and this often leads to their disfavor. In addition, the ancillary items are often strewn about, as there is no provision for the storage of such items in conjunction with the structure.

It is accordingly a purpose of the present invention to provide a play structure, such as a dollhouse, which may be collapsed from its fully upright form to a compact structure, well adapted for storage and transport.

Yet another purpose of the present invention is to provide a play structure which is collapsible and includes integral storage means for ancillary parts.

Yet a further purpose of the present invention is to provide such a structure in a form which may be easily erected and collapsed, which is convenient and efficient to manufacture, and which has no loose parts that need to be assembled or attached for assembly.

In accordance with the foregoing and other objects and purposes, the play structure of the present invention includes a base having integral storage units, such as drawers, which allows the storage of doll furniture and like items, and which provides a rigid support for the unit in both the erected and collapsed positions. Pivotly mounted to the base and extending vertically upward therefrom are a pair of spaced parallel walls which define the opposite side walls of the play structure. Pivotly mounted to and between the walls are a plurality of horizontal panel elements defining the floors of the playhouse. A member defining the front wall of the structure extends vertically between the front edges of the side walls, and is pivotly mounted to one of the horizontal members, and preferably the uppermost one thereof. Each of the side wall, floor and front wall elements are pivotly interconnected such that the resulting assemblage may be folded down into a compact unit on top of the base. By pivoting the panel elements to their upright, assembled position, a multi-level structure is created, the front wall being fastened with lock means to the horizontal panel elements, thus forming a rigid, self-standing structure. Internal pivotable partition panels may be provided to define subvolumes between adjacent horizontal panels, corresponding to rooms of the structure, and additional pivotable panel elements, defining a roof structure, may be provided. When play with the structure is finished, each of the panels is again pivotable such that the structure may be collapsed onto the base unit, resulting again in a compact unit which may be easily stored or transported.

BRIEF DESCRIPTION OF THE DRAWINGS

A fuller understanding of the features of the present invention will be realized upon consideration of the following description of a preferred, but nonetheless illustrative embodiment of the invention when taken in conjunction with the annexed drawings, wherein:

FIG. 6 is a rear elevation view of the resulting structure in the upright and self-supporting position illustrating the various structural elements thereof, complete with ancillary dollhouse furniture and the like in place;

FIG. 7 is a partial rear elevation view, in section, taken along line 7—7 of FIG. 6, illustrating the operation and construction of an interior divider;

FIG. 8 is a partial elevation view, in section, taken along line 8—8 of FIG. 6, further detailing the means of connection between side wall and horizontal panels.

DETAILED DESCRIPTION OF A PREFERRED EMBODIMENT

Figure 3:
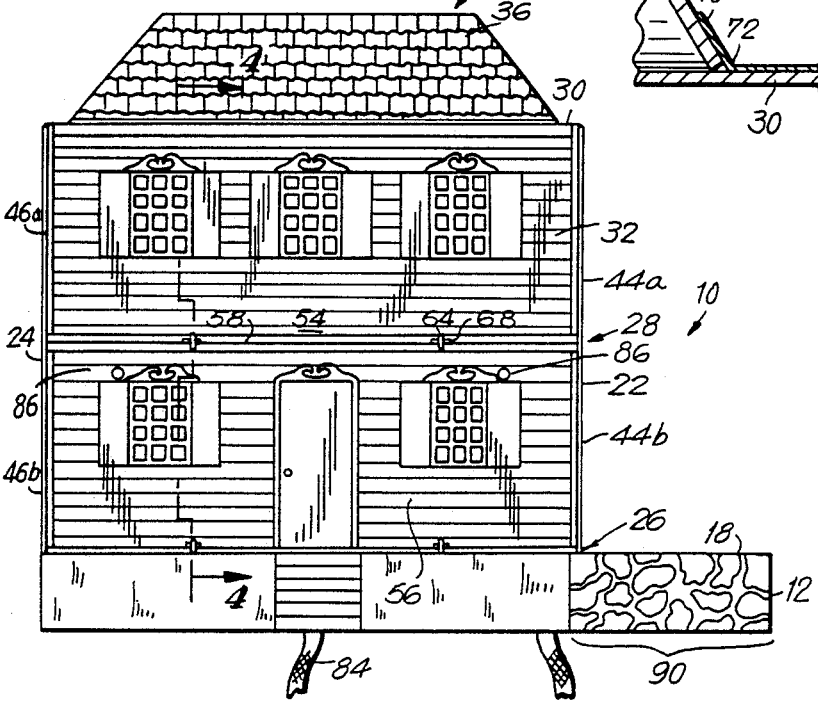
FIG. 3 is a front elevation view of the present invention illustrating the resulting play structure in the erected and upright configuration.

Referring initially to FIGS. 3 and 6, the play structure 10 of the present invention comprises a generally hollow rectangular parallelepiped base 12, having indicia on its outer surfaces to simulate the house foundation and surrounding area, such as a patio or the like. Into the rear of base 12 are mounted a plurality of drawers 14 in a conventional manner to provide storage. The drawers are accessible from the rear of the structure, as shown in FIG. 6, each drawer being provided with a pivoting lock element 16 mounted to the upper frame portion 18 of the base, as well as a finger pull 20. Extending upwardly from base 12 is a pair of opposed side wall panels 22, 24, each of which defines an exterior side wall of the play structure.

Horizontal panels 26, 28 and 30 extend between the side walls 22, 24 to define the floors and ceilings of the structure interior. The lowermost panel 26 may be rigidly affixed to the base 12 by a suitable adhesive or similar means to form a part thereof. A front wall panel 32 extends vertically between the lowest floor panel 26 and second floor ceiling panel 30, and defines the front wall of the structure. As seen in FIG. 6, the rear of the structure is open to allow access to the "rooms" of the structure. Roof 34, comprising central panel 36 and side panels 38, 40, extends upwardly from second floor ceiling panel 30 to define the roof of the structure. Each of the aforementioned panels may be adorned with appropriate indicia on its surfaces to accurately represent the appropriate structure modeled, such as the depicted multi-story, single-family, private residence.

Figure 9:
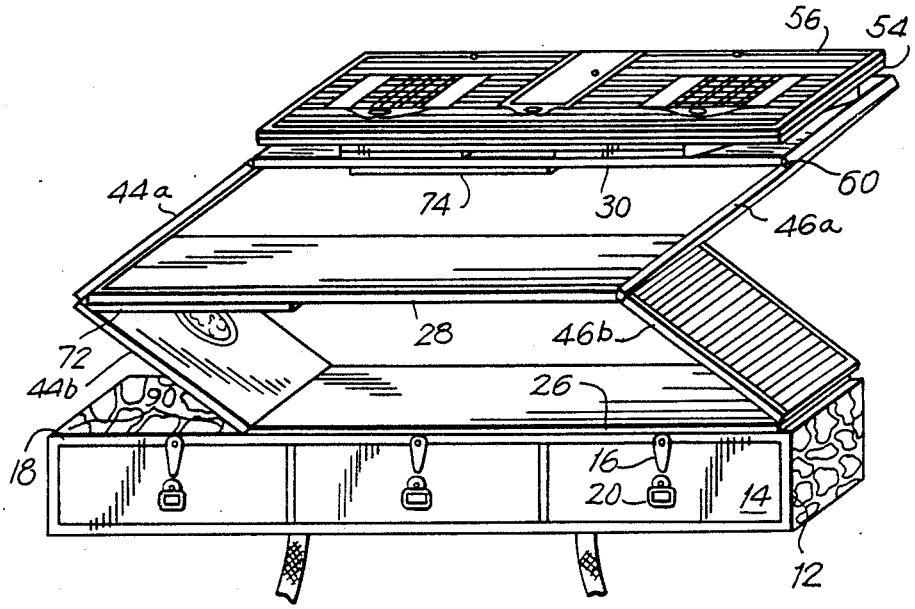
FIG. 9 is a rear elevation view depicting the assembly in transition between the collapsed and assembled configurations.

Side walls 22, 24 are each pivotly mounted to lowermost horizontal panel 26 by means of a hinge joint 42 mounted to both the lower edge of the side wall panel and the end edge of the horizontal panel 26. Similarly, the horizontal panels 28 and 30, defining the upper floors and ceilings of the structure, are each pivotly attached along their opposed end edges to the side wall elements 22, 24 by similar hinge means. Each of the horizontal panels may be formed of a unitary piece of an appropriate sheet material, such as cardboard, plastic, fibreboard or the like, or a similar molded composition, upon which the appropriate decorative indicia is applied. The side walls 22, 24 may be similarly formed of a sheet or molded material, and each may preferably comprise a pair of subpanels 44*a,b,* 46*a,b,* respectively, pivotly joined together and to horizontal panel 28 along the line of intersection with horizontal panel 28, as can be seen in FIGS. 8 and 9.

As may be best seen in FIG. 8, a typical hinge 48, located at such a panel intersection, is formed of one or more U-shaped clamp element portions 50, each dimensioned to accept an edge of an adjacent panel element, such as side wall upper panel element 46*a,* side wall lower panel element 46*b,* and second floor horizontal panel 28. As seen in FIG. 8, second floor panel 28 is of increased thickness with respect to the wall panel elements, but such a relationship is not critical to the construction. Each of the U-shaped clamp element portions 50 is connected to its adjacent element(s) along a common edge 52, such edge serving as the self-hinge or pivot line for hinge action. Alternative hinge structures may be employed as dictated by the specific location and construction desired, as may be seen herein. Such hinges may advantageously be manufactured of thin wall plastic in a manner well known in the art.

Figure 4:
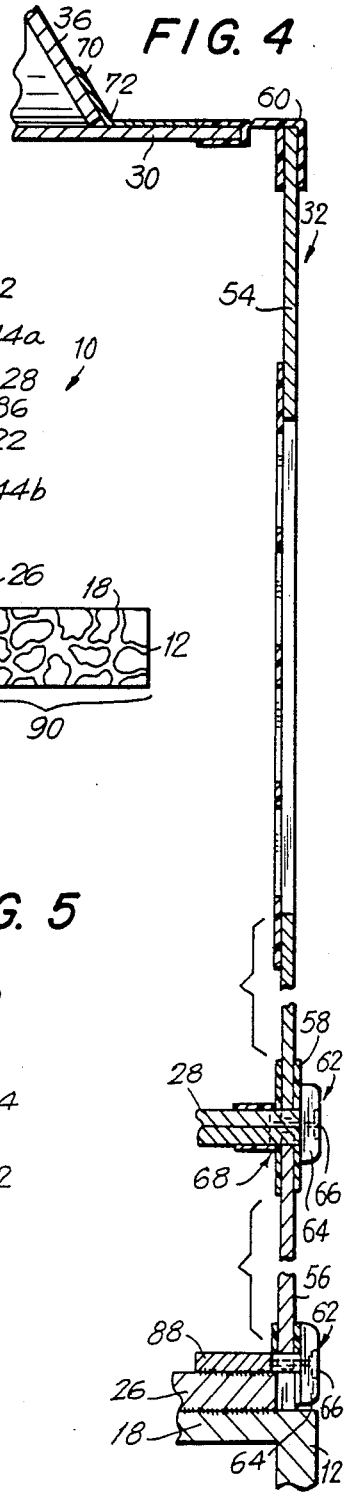
FIG. 4 is a partial end elevation view, in section, taken along line 4—4 in FIG. 3, illustrating the interconnection of the various panel elements of the structure.

As may be best seen in FIG. 4, front wall panel 32 may be advantageously formed of an upper rectangular panel element 54 and a lower rectangular panel element 56 joined along their adjacent horizontal edges by hinge member 58. The upper horizontal edge of panel 54 is pivotly mounted to the front edge of second floor ceiling member 30 by hinge member 60. It is to be noted that, in order to allow 270 degree rotation of the front wall panel 32 about second floor ceiling member 58, a modified structure for hinge 60 is utilized. Front wall panel 32 is maintained in the open and unfolded position against the front edges of horizontal panels 26 and 28 by lock means 62, each of which comprise a pivoting head member 64 mounted to a shaft or pin member 66 inserted into and projecting from the edge of the appropriate horizontal panel member. The head members 64 align with and are dimensioned to pass through horizontal slots 68 in front wall panel 32, and are pivotable from the horizontal position to the vertical, locking position, as may be seen in FIG. 3. The lock means 62 located at the front edge of lowermost horizontal panel 26 may be mounted to a support block 88 to space the lock means from the lower edge of lower front wall panel 56. In a preferred embodiment, the upper and lower front wall panel elements 54,56 are sized such that hinge 58 is positioned adjacent the front edge of horizontal panel 28, such that the lock means 62 extends through the hinge material, rather than the front panel material.

Figure 5:
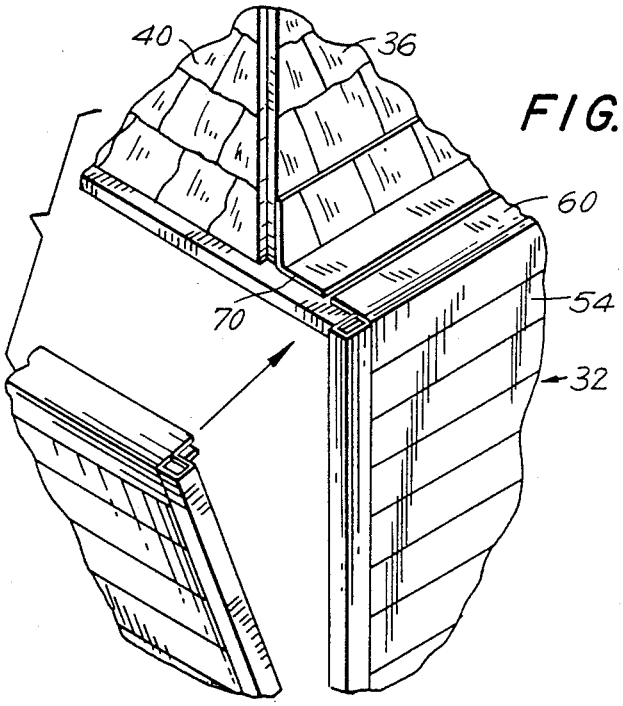
FIG. 5 is a detailed perspective view of an upper corner portion of the resulting structure illustrating a means by which the adjacent panel elements are mounted to each other.

Roof central panel 36 is pivotly mounted to the upper surface of second floor ceiling panel 30 adjacent the front edge thereof by hinge element 70, which may be a simple planar plastic element, having a scored self-hinge pivot line 72 located at the interface of the attached panels. The roof side panels 38, 40 are similarly pivotly joined to roof central panel 36, either by a discrete hinge element or by use of a scored line extending through the panel material itself to provide a self-hinge effect. In either event, the side roof panels 38, 40 are so dimensioned as to retain the front panel 36 in a pitched orientation, as seen in FIGS. 4 and 5, when pivoted to the operative position. When closed, the side elements 38, 40 abut against the inner surface of central panel 36, thus permitting the roof assembly to pivot back as shown by the arrow in FIG. 4.

Referring next to FIGS. 6 and 7, internal vertical partition panels 74, 76 are utilized to subdivide the spaces between side wall panels 22, 24 and horizontal panels 26–30 into room areas. As may be seen in FIG. 7, representative partition panel 74 is mounted to second floor ceiling 30 by an appropriate hinge element 78 along the partition's upper edge. This permits the partition 74 to pivot from a transport position, parallel and adjacent to horizontal panel 30, as shown in phantom, to the vertical position between horizontal panel 28 and 30 upon assembly of the structure. Appropriate means, such as hook and loop fabric elements 80 or other connector means, may be utilized to maintain the divider panel in the transit position as may be required. The exposed lower edge of partition 74, like the rear vertical edges of side wall elements 22, 24 the rear edges of horizontal elements 26–30 and other exposed edges, may be provided with an extruded plastic molding 82 to provide a finished surface and to prevent delamination or fraying of the pieces. This edge molding 82 may be manufactured from the same plastic as the hinge elements.

Figure 2:
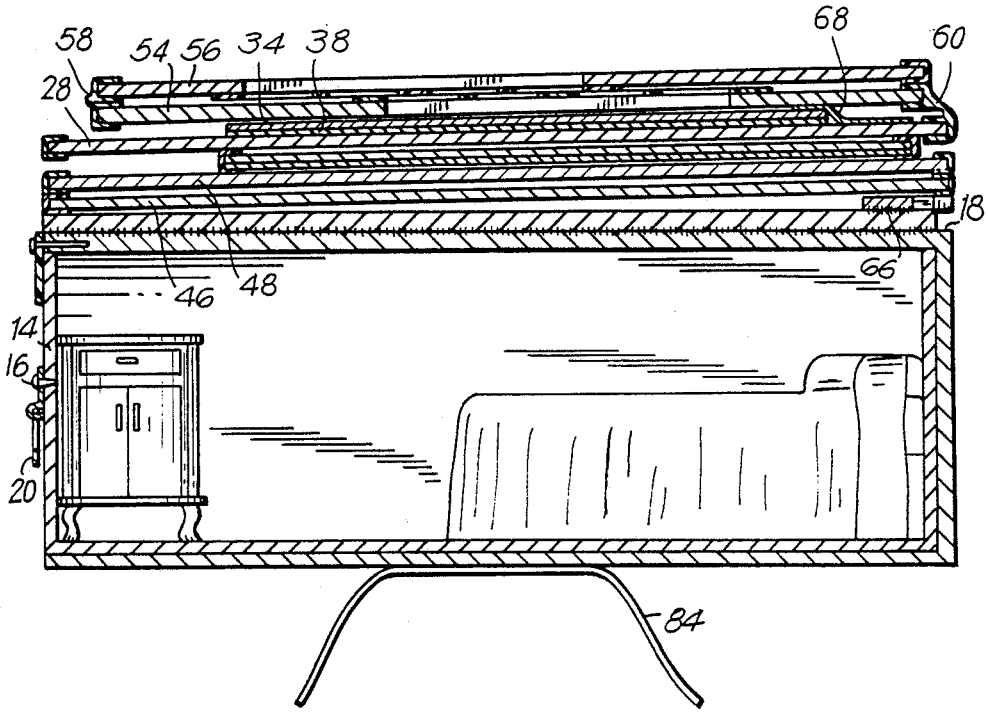
FIG. 2 is an end elevation view, in section, taken along line 2—2 of FIG. 1, illustrating the folding of the individual panel elements.

As seen in FIGS. 2 and 9, all the hinged elements constituting the play structure of the present invention may be folded into a compact assemblage resting directly upon the top surface of base 12. In particular, and as shown in FIGS. 2 and 9, lower panels 44*b* and 46*b* of side walls 22 and 24, respectively, pivot such that panel 44*b* overlies base top surface 18 and panel 48*b* overlies lowermost horizontal panel 26. The upper floor portion of the structure, comprising horizontal elements 28 and 30 and upper portions 44*a* and 46*a* of side walls 22, 24 overlie the lower portion, followed by roof panels 36–40 resting on horizontal panel 30. Front wall panels 54, 56 are folded back over the roof panels.

Figure 1:
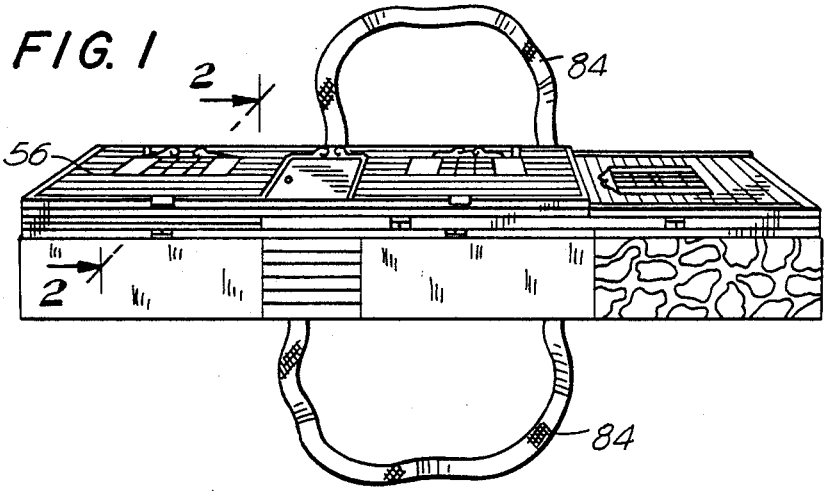
FIG. 1 is a perspective view of the play structure in the collapsed state, appropriate for storage or transport.

Handles 84, as shown in FIGS. 1 and 2, are affixed to the base and allow the collapsed structure to be carried about easily. When it is desired to erect the structure, walls 22, 24 are raised, and front wall panels 54,56 are pivoted down from horizontal panel element 30 and locked in position by the lock means 62. This locking rigidly maintains the structure in the erected position, at which time roof panels 36–40 may be pivoted open and partitions 74 lowered. When it is desired to collapse the structure, knobs 86 on front panel element 56, seen in FIG. 3, may be utilized to grip the front panel and pivot it upward onto horizontal panel element 30 after lock means 62 are disengaged. Drawers 14 may be opened, allowing access to the enclosed furniture and the like, which may be utilized in conjunction with the structure as desired as depicted in FIG. 6. Pivoting lock elements 16 insure that the drawers 14, which are accessible even in the collapsed configuration, remain closed during transit to safely store the elements enclosed therein.

In an especially preferred embodiment, the heights of lower side wall panels 44*a*, b are equal and substantially equal to the sideward projection 88 of base 18 beyond the wall of the structure so that, in the collapsed form, as best seen in FIG. 1, there are no protruding panels or edges. In addition, the height of the structure is chosen to be approximately twice its depth, so that front wall panels 54, 56 overlie the horizontal panel 30 in the folded configuration without projection beyond the edges thereof.

I claim:

1. A collapsible play structure, comprising an enclosed box-like base unit having storage means located therein; a pair of opposed parallel and upright side wall panels, each of which having pairs of opposed upper and lower and front and back edges, each of said wall panels being pivotly mounted to said base along said lower edge; a plurality of horizontal panels, each of which having pairs of opposed first and second sides and front and back edges, each of said horizontal panels being pivotly mounted to and between said side walls along said sides of said horizontal panels; a front wall panel extending upwardly between said side walls between the front edges thereof and extending horizontally between said side walls, said front wall panel being pivotly attached to the front edge of one of said horizontal panels by a hinge means; and lock means mounted to said horizontal panels and said front wall panel to retain said horizontal and front wall panels in an abutting relationship whereby the structure is retained in the upright and upstanding position.

2. The structure of claim 1 further including a roof element pivotly mounted to the uppermost of said horizontal panels.

3. The structure of claim 1, wherein said front wall panel is mounted to the uppermost of said horizontal panels.

4. The structure of claim 3, wherein each of said side wall panels comprise a pair of rectangular panels pivotly joined by hinge means located along their adjacent horizontal edges.

5. The structure of claim 4, wherein said rectangular wall panels are of equal height and said base projects outwardly beyond one of said side walls a distance approximately equal to said wall panel height, said one of said wall panels being adapted to pivot to a position overlying said outwardly projecting base portion.

6. The structure of claim 5, wherein the height of said side walls is approximately equal to twice the width of said side walls.

7. The structure of claim 3, wherein said front wall panel comprises a pair of rectangular panels pivotly joined by hinge means located along their adjacent horizontal edges.

8. The structure of claim 5, wherein said rectangular front wall panels are of equal height and are of height approximately equal to the width of said uppermost horizontal panel.

9. The structure of claim 8, wherein said rectangular wall panels are of equal height and said base projects outwardly beyond one of said walls a distance approximately equal to said height, said one of said wall panels adapted to pivot to a position overlying said outwardly projecting base portion, said rectangular front wall panels being of equal height and approximately equal to the width of said uppermost panels.

10. The structure of claim 9, wherein the height of said side walls is approximately equal to twice the width of said side walls.

11. The structure of claim 9 further comprising at least one interior panel pivotly mounted to one of said horizontal panels adapted to extend between two adjacent of said horizontal panels to divide the volumes therebetween into subvolumes when in the vertical position.

12. The structure of claim 11, wherein said interior panel is selectively maintainable in a horizontal position adjacent the horizontal panel to which it is mounted.

13. The structure of claim 3, wherein each of said side wall panels and said front wall panels, comprise a pair of rectangular panels pivotly joined along their adjacent horizontal edges.

* * * * *